US007296565B2

(12) United States Patent
Kim et al.

(10) Patent No.: US 7,296,565 B2
(45) Date of Patent: Nov. 20, 2007

(54) COOLING APPARATUS OF COOKING APPLIANCE

(75) Inventors: Yang Kyeong Kim, Buchun-si (KR); Jae Kyung Yang, Seoul (KR); Wan Soo Kim, Kwangmyung-si (KR); Jong Sik Kim, Koyang-si (KR)

(73) Assignee: LG Electronics Inc., Seoul (KR)

( * ) Notice: Subject to any disclaimer, the term of this patent is extended or adjusted under 35 U.S.C. 154(b) by 259 days.

(21) Appl. No.: 11/039,806

(22) Filed: Jan. 24, 2005

(65) Prior Publication Data

US 2005/0224068 A1 Oct. 13, 2005

(30) Foreign Application Priority Data

Apr. 12, 2004 (KR) ..... 10-2004-0025006

(51) Int. Cl.
*F24C 15/04* (2006.01)
*F23M 7/00* (2006.01)

(52) U.S. Cl. ..... 126/198; 126/193; 126/21 R

(58) Field of Classification Search ..... 126/198, 126/21 R, 193, 200; 219/391, 393, 400
See application file for complete search history.

(56) References Cited

U.S. PATENT DOCUMENTS 4,418,261 A * 11/1983 Jailor et al. ..... 219/757
5,107,821 A * 4/1992 von Blanquet ..... 126/19 R
5,441,036 A * 8/1995 Mikalauskas et al. ..... 126/198
5,626,127 A * 5/1997 Maitland et al. ..... 126/523
6,904,904 B2 * 6/2005 Walther et al. ..... 126/198
2005/0109335 A1 * 5/2005 Beck et al. ..... 126/198

FOREIGN PATENT DOCUMENTS

DE 88 00 332 U1 4/1988
DE 100 47 016 A1 4/2002
EP 1 022 517 A1 7/2000
KP 2001-0066589 A 7/2001

* cited by examiner

*Primary Examiner*—Kenneth Rinehart
*Assistant Examiner*—Chuka C Ndubizu
(74) *Attorney, Agent, or Firm*—Birch, Stewart, Kolasch & Birch, LLP

(57) ABSTRACT

A cooling apparatus of a cooking appliance including a cabinet having a cooking chamber located therein and an electric component chamber located outside the cooking chamber; a door installed on the cabinet for opening and closing the cooking chamber, and having channels so as to cause external air to flow into the electric component chamber and a part of the air to flow into the electric component chamber via side surfaces of the cooking chamber; and an air blower installed in the electric component chamber for forcibly sucking in the external air and discharging air having cooled the door and the electric component chamber, thereby improving cooling efficiency of the door and the inside of the electric component chamber.

14 Claims, 8 Drawing Sheets

COOLING APPARATUS OF COOKING APPLIANCE

BACKGROUND OF THE INVENTION

1. Field of the Invention

The present invention relates to a cooling apparatus of a cooking appliance, such as an oven, and more particularly, to a cooling apparatus of a cooking appliance for cooling electric components in a cabinet and a door.

2. Description of the Related Art

FIG. 1 is a partially exploded perspective view of a cooking appliance, particularly an oven, provided with a conventional cooling apparatus, and FIG. 2 is a sectional view of FIG. 1, taken along line A-A.

The oven as shown in FIG. 1 comprises a cabinet 1 having an opened front surface, a cooking chamber 2 installed in the cabinet 1 and heated such that food therein is cooked, a door 7 installed on the opened front surface of the cabinet 1 for opening and closing the cooking chamber 2, and an air blower 4 installed in an electric component chamber 3 located on the upper part of the cooking chamber 2 for cooling electric components in the cabinet 1.

The cooking chamber 2 is heated by an electric heater or a burner.

The air blower 4 serves to form a cooling channel due to a high temperature generated when the oven performs a cooking operation and an automatic cleaning operation using pyrolysis, and generally includes a fan 5 and a fan motor 6 for operating the fan 5.

The fan 5, as shown in FIG. 2, is installed at the rear part of the electric component chamber 3, and forcibly discharges air in the electric component chamber 3 toward the front part of the electric component chamber 3, at which the door 7 is placed, thereby cooling the air in the electric component chamber 3.

The door 7 is directly heated by heat radiated and heat convected from the inside of the cooking chamber 2, thus having a cooling structure. The cooling structure of the door 7 is configured such that a channel 9 for passing external air is formed between two glass plates 8 disposed in parallel.

The above channel 9 of the door 7 is connected to a discharge channel 1*a* of the fan 5.

Accordingly, when the air in the electric component chamber 3 is forcibly discharged by the fan 5, the hot current of air in the door 7 is exhausted to the outside and cooled by the principle of sucking the air passing through the door 7 according to Bernoulli's Equation using a difference of velocities of an exhausted air flow.

Here, various cooking appliances, such as an oven and a microwave oven, use a pyrolysis system for increasing the temperature of the cooking chamber 2, and cook foods in a state, in which the temperature of the cooking chamber 2 is more than 500° C., thereby requiring a cooling structure of the door 7 for coping with the above condition.

However, since the above-described conventional cooling structure of the cooking appliance is configured such that the air in the door 7 is sucked and discharged by means of a difference of velocities of the air discharged from the electric component chamber 3, in case that the quantity of the air current for cooling the door 7 is small and the blowing force of the fan 5 is deteriorated due to long-term use, the air discharged from the electric component chamber 3 flows again into the channel 9 of the door 7, thereby remarkably deteriorating the cooling capacity of the door 7.

Particularly, the above-described conventional cooling structure of the door is not suitable for cooking appliances, which perform an automatic cleaning operation using pyrolysis at a high temperature.

SUMMARY OF THE INVENTION

Therefore, the present invention has been made in view of the above problems, and it is an object of the present invention to provide a cooling structure of a cooking appliance, which forms a suction channel for supplying a sufficient quantity of air to a door, thereby increasing cooling efficiency of the door and efficiently cooling an electric component chamber.

In accordance with one aspect of the present invention, the above and other objects can be accomplished by the provision of a cooling apparatus of a cooking appliance comprising: a cabinet having a cooking chamber located therein and an electric component chamber located outside the cooking chamber; a door installed on the cabinet for opening and closing the cooking chamber, and having channels so as to cause external air to flow into the electric component chamber and a part of the air to flow into the electric component chamber via side surfaces of the cooking chamber; and an air blower installed in the electric component chamber for forcibly sucking the external air and discharging air having cooled the door and the electric component chamber.

Preferably, suction vents connected to the channels may be formed through at least one surface of side surfaces and an upper surface of the door.

Further, preferably, at least two channels may be formed at inside and outside portions of the door.

Moreover, preferably, the channels of the door may be formed among a plurality of plates separated from each other by a designated interval.

Preferably, the channels of the door may communicate with each other through circulation slits formed through the plates.

Further, preferably, the air may flow from the channel of the door located at the outside of the door to the channel of the door located at the inside of the door, or from the channel of the door located at the inside of the door to the channel of the door located at the outside of the door.

Moreover, preferably, side vents for causing the air to flow into both side surfaces of the cooking chamber may be formed through the inner surface of the door.

Preferably, top vents for discharging the air to the electric component chamber may be formed through the upper surface of the door.

Further, preferably, the channel for sucking the air into the air blower and the channel for discharging the air from the air blower may be separated from each other. Moreover, preferably, a discharge duct for discharging the air may be connected to the air blower in front of the cabinet.

In accordance with another aspect of the present invention, there is provided a cooling apparatus of a cooking appliance comprising: a cabinet having a cooking chamber located therein and an electric component chamber located outside the cooking chamber; a door installed on the cabinet for opening and closing the cooking chamber, and having at least two suction channels formed among a plurality of plates so as to cause external air to flow into the electric component chamber; and an air blower installed in the electric component chamber for forcibly sucking the external air and discharging air having cooled the door and the electric component chamber.

The cooling apparatus of the cooking appliance of the present invention sucks external air through the door, and circulates the sucked air to the door and the inside of the electric component chamber so as to cool the door and the inside of the electric component chamber, thereby improving cooling efficiency of the door and the inside of the electric component chamber.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
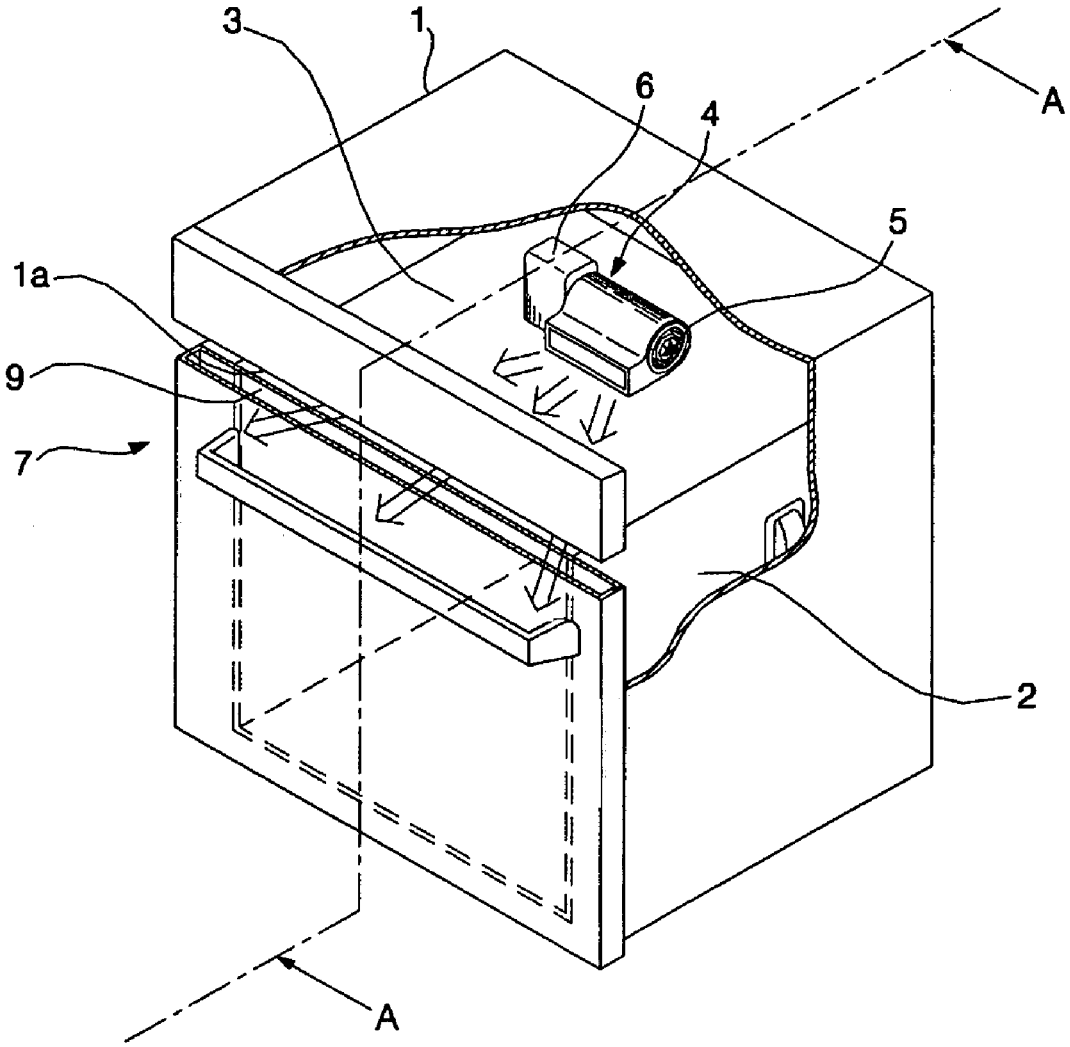
FIG. 1 (Prior Art)
FIG. 1 is a partially exploded perspective view of a cooking appliance provided with a conventional cooling apparatus.
Figure 2:
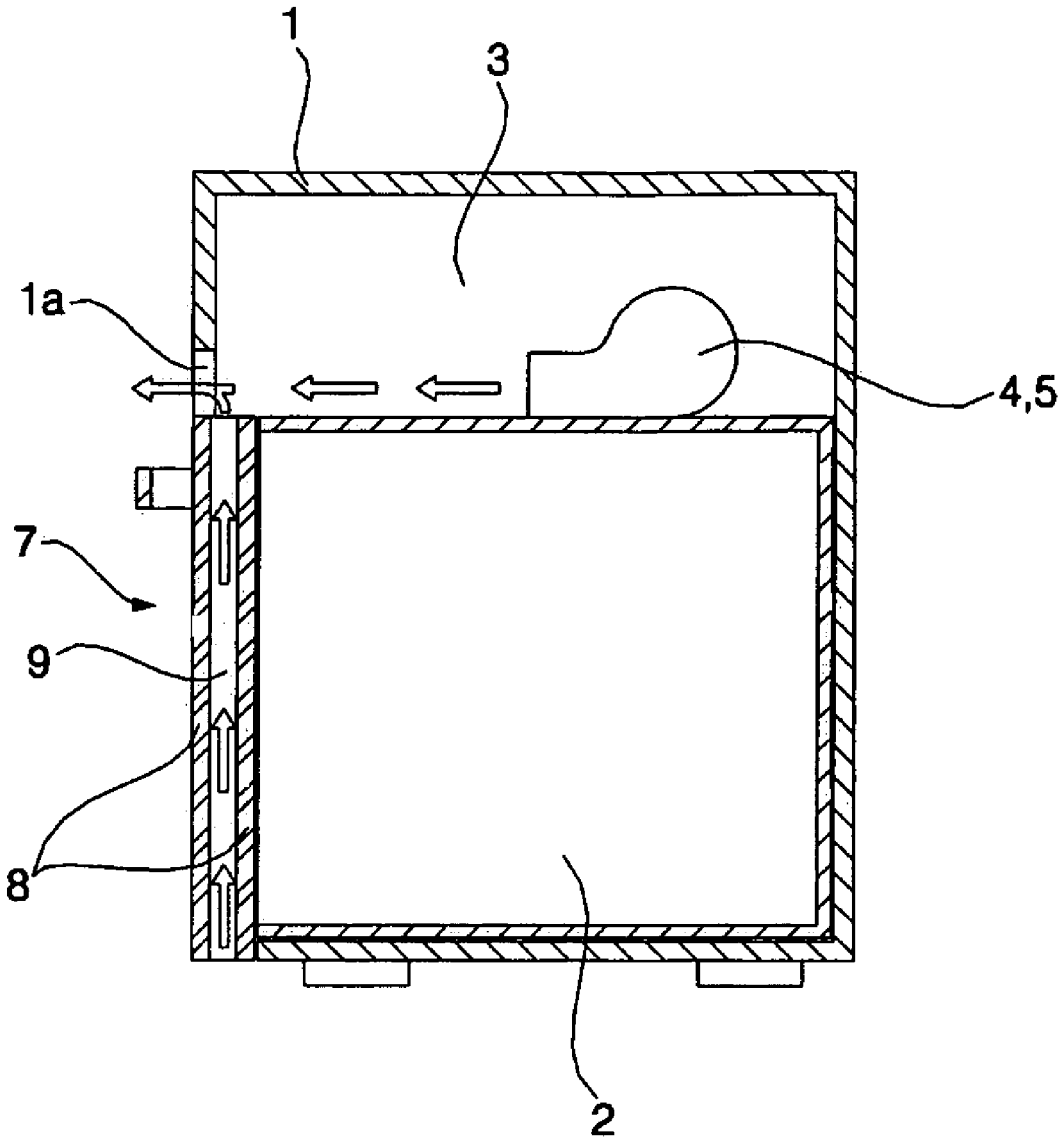
FIG. 2 (Prior Art)
FIG. 2 is a sectional view of FIG. 1, taken along line A-A.
Figure 3:
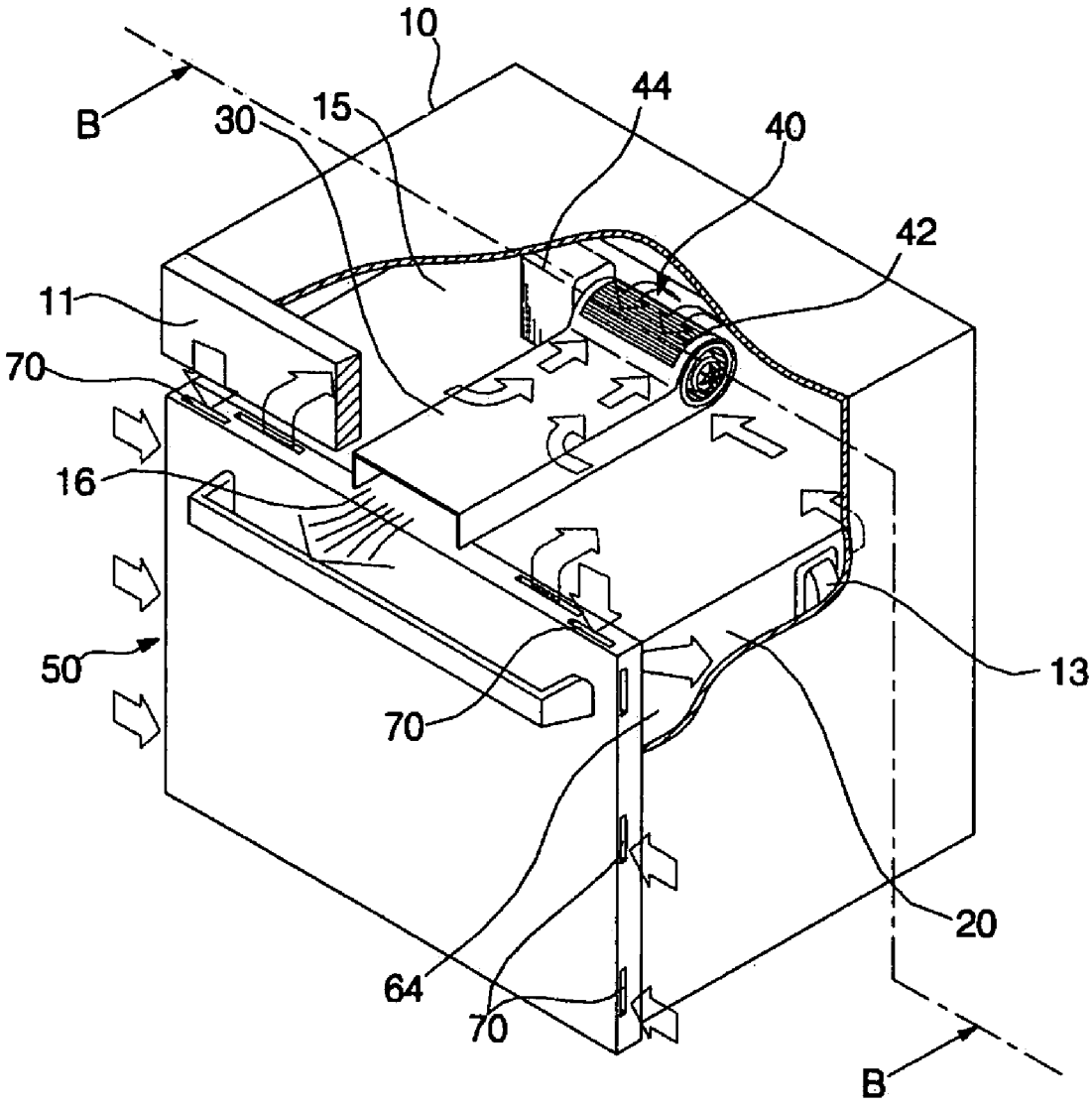
FIG. 3 is a partially exploded perspective view of a cooking appliance provided with a cooling apparatus in accordance with an embodiment of the present invention.
Figure 4:
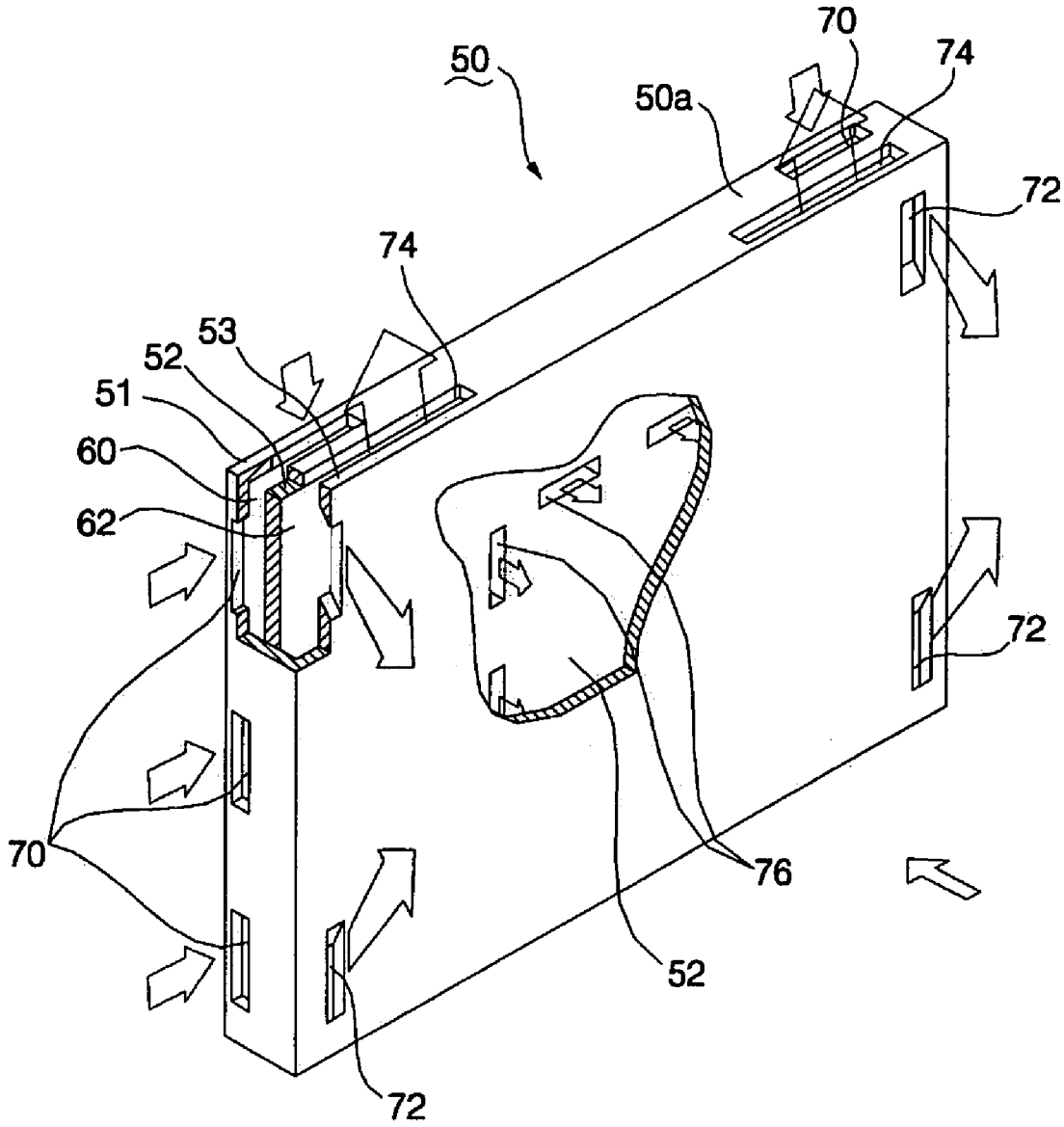
FIG. 4 is a partially exploded perspective view illustrating the structure of a door of the cooking appliance in accordance with the embodiment of the present invention.
Figure 5:
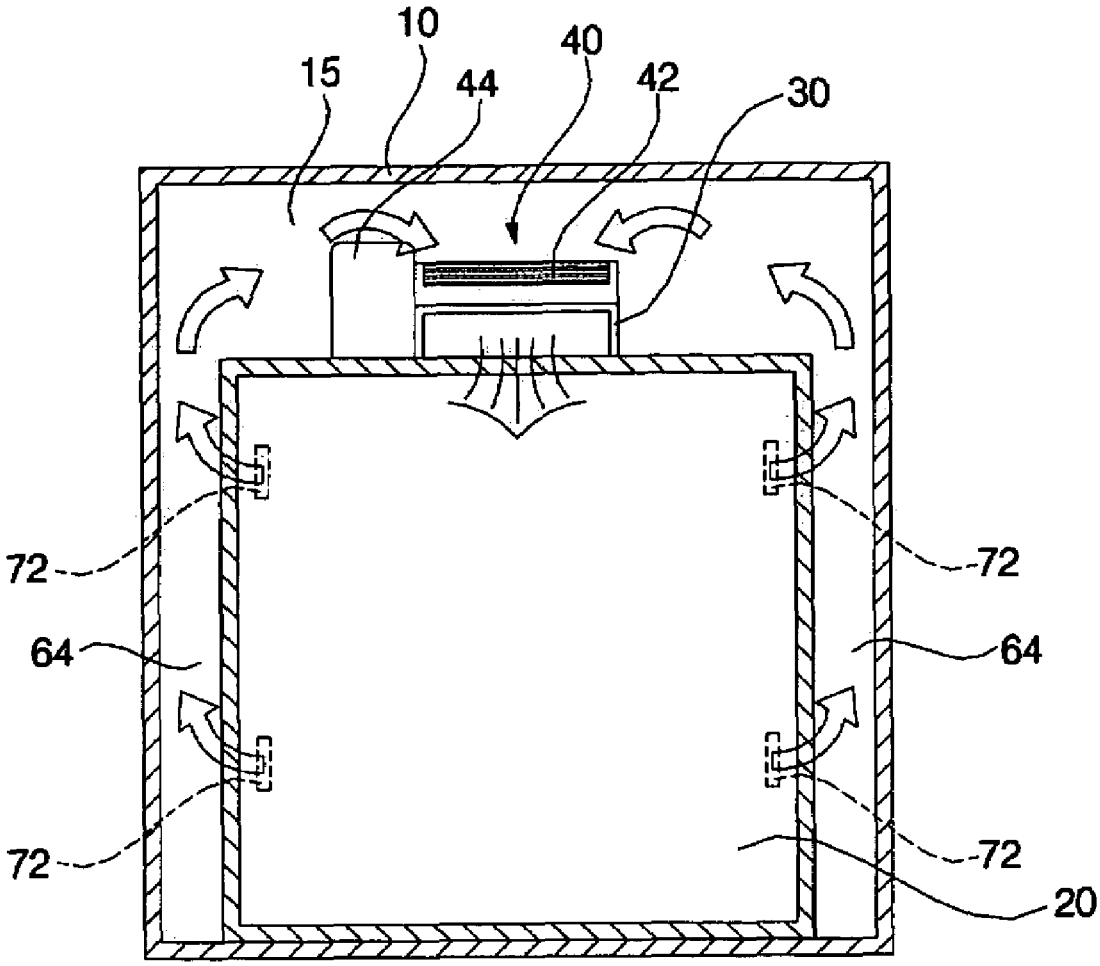
FIG. 5 is a sectional view of FIG. 3, taken along line B-B.

FIGS. 3 to 5 illustrate a cooking appliance provided with a cooling apparatus in accordance with one embodiment of the present invention. More particularly, FIG. 3 is a partially exploded perspective view of the cooking appliance provided with the cooling apparatus, FIG. 4 is a partially exploded perspective view illustrating the structure of a door of the cooking appliance, and FIG. 5 is a sectional view of FIG. 3, taken along line B-B, illustrating the internal structure of a cabinet, from which the door is opened.

As shown in FIG. 3, the cooking appliance in accordance with one embodiment of the present invention comprises a cabinet 10 defining an external appearance, a cooking chamber 20 installed in the cabinet 10 such that food therein is cooked, a door 50 installed on the front surface of the cabinet 10 for opening and closing the cooking chamber 20, and an air blower 40 for sucking external air into the cabinet 10 and then discharging the air to the outside.

The door 50 is rotatably installed on the front surface of the cabinet 10. With reference to FIG. 4, door channels 60 and 62 are respectively formed between a plate member 51 and a plate member 52 and between the plate member 52 and a plate member 53 in the door 50, and external air flows into the cabinet 10 through the channels 60 and 62.

A discharge slit 16 for discharging air through the air blower 40 is formed between an upper surface 50*a* of the door 50 and a front plate 11 of the cabinet 10.

An electric component chamber 15, in which various electric components are installed, is located at the upper part of the cooking chamber 20. Here, the cooking appliance is operated by the above electric components, and air flows in the cooking appliance. In this embodiment, the drawings illustrate only the air blower 40 out of the electric components.

The cooking chamber 20 is placed in the cabinet 10 such that both side surfaces of the cooking chamber 20 are separated from the inner surface of the cabinet 10 by a designated interval through separation members 13, and side channels 64 are formed so that air flows through the separation spaces between the cooking chamber 20 and the cabinet 10.

The air blower 40 serves to suck external air into the cabinet 10 so that the door 50 and the electric component chamber 15 are cooled by the sucked air, and then to discharge the air to the outside, and includes a fan 42 for circulating the air, and a motor 44 for supplying driving power to the fan 42. Preferably, the fan 42 is a cross flow fan, which is easily placed in the electric component chamber 15 and maximizes air suction dimensions.

A discharge duct 30 for discharging the air, having cooled the door 50 and the electric component chamber 15, through the discharge slit 16 is connected to an outlet of the air blower 40.

Now, with reference to FIG. 4, the structure of the above-described door 50 will be described in detail. The door 50 includes the first, second, and third plates 51, 52, and 53 for forming the door channels 60 and 62. The first, second, and third plates 51, 52, and 53 are separated from each other by the designated interval.

A plurality of suction vents 70 for sucking air are formed through the edges of the door 50, side vents 72 for discharging air to the side channels 64 are formed through both edges of the third plate 53, and top vents 74 for causing air to flow into the electric component chamber 15 are formed through the upper surface 50*a* of the door 50.

The suction vents 70 communicate with the external channel 60 of the door 50 so that the air sucked through the suction vents 70 flows to the external channel 60.

A plurality of the side vents 72 are formed through the upper and lower portions of the edges of the third plate 53, and serve to discharge the air discharged from the internal channel 62 of the door 50 to the side channels 64 (see also FIG. 5).

Circulation slits 76 for communicating the door channels 60 and 62 with each other are formed through the second plate 52, and serve to circulate the air, sucked into the external channel 60 therethrough, into the internal channel 62.

Now, the functions and effects of the cooling apparatus of the cooking appliance in accordance with the above embodiment of the present invention will be described.

Figure 6:
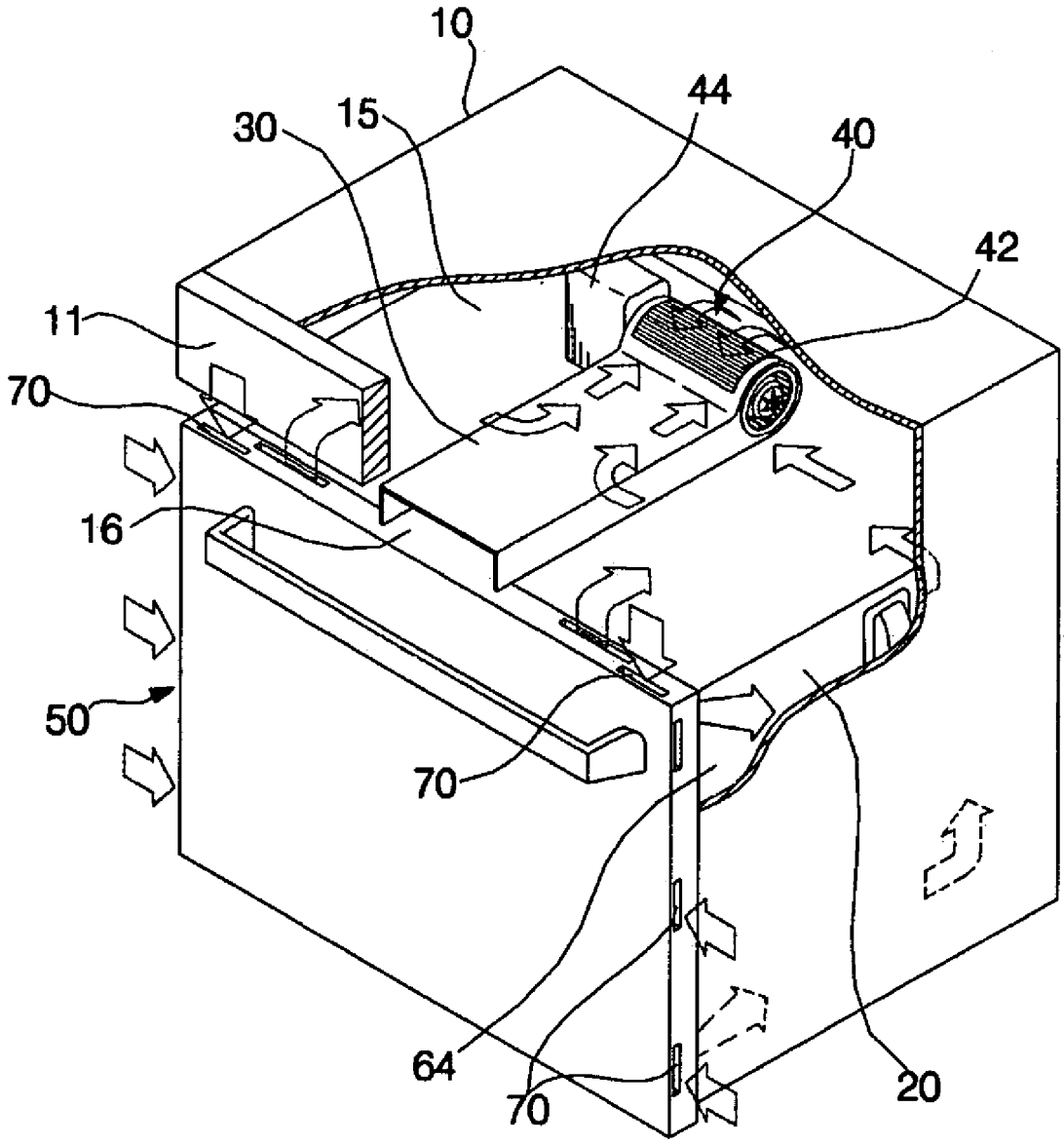
FIG. 6 is a perspective view of the cooking appliance, in a state in which air is sucked into the cooking appliance, in accordance with the embodiment of the present invention.
Figure 7:
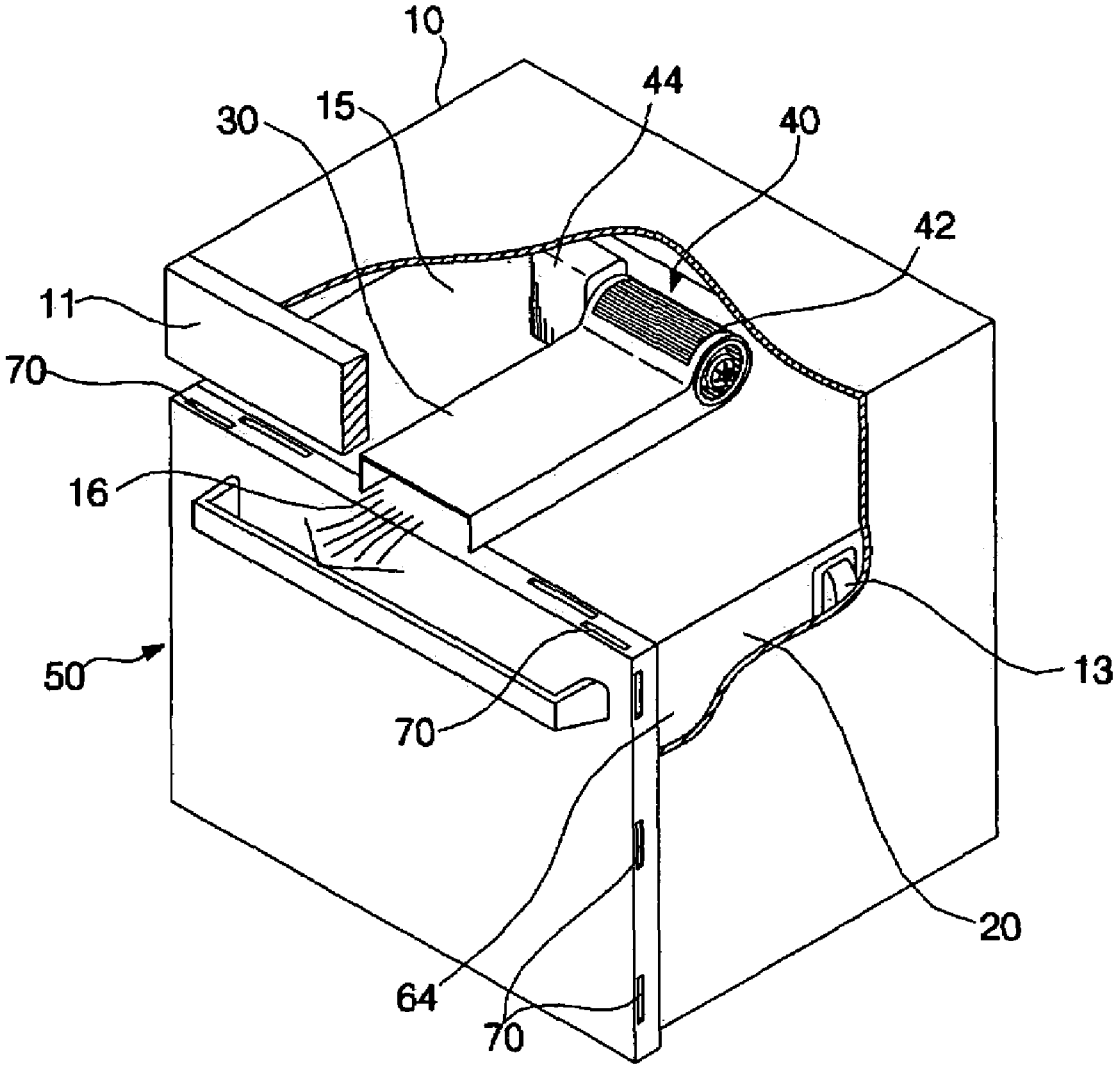
FIG. 7 is a perspective view of the cooking appliance, in a state in which air is discharged from the cooking appliance, in accordance with the embodiment of the present invention.

FIG. 6 is a perspective view of the cooking appliance, in a state in which air is sucked into the cooking appliance, in accordance with this embodiment, and FIG. 7 is a perspective view of the cooking appliance, in a state in which air is discharged from the cooking appliance, in accordance with this embodiment.

First, the motor 44 installed in the electric component chamber 15 of the cabinet 10 is driven by current applied thereto, and then operates the fan 42, thereby generating a suction force.

The suction force generated by the fan 42 sucks the air to the inside of the external channel 60 of the door 50 through the suction vents 70 of the door 50. The air sucked into the external channel 60 flows toward the internal channel 62 of the door 50 by means of a difference of pressures due to the flow of the air generated from the air blower 40, and the air flows toward the internal channel 62 through the circulation slits 76.

Here, the air flowing from the external channel 60 of the door 50 to the internal channel 62 of the door 50 eddies around the circulation slits 76. The cooling time of the door 50 is lengthened by the eddy.

The air, having flown to the internal channel 62, is discharged from the door 50 through the side vents 72 and the top vents 74. The air discharged through the top vents 74 directly flows into the electric component chamber 15, thereby cooling various electric components in the electric component chamber 15 and then being sucked into the fan 42.

The air discharged through the side vents 72 is discharged toward the side channels 64 formed between the cooking chamber 20 and the cabinet 10, and the air discharged toward the side channels 64 flows into the electric component chamber 15 along the side channels 64. Here, the air flowing into the electric component chamber 15 has a temperature lower than that of the air retained in the side channels 64, thereby cooling the cooking chamber 20 and the cabinet 10, and flowing into the electric component chamber 15 by means of the convection and the flow of the air generated from the fan 42.

The air flowing into the electric component chamber 15 is circulated into the electric component chamber 15 to cool the electric components, and is then sucked into the air blower 40.

The air sucked into the air blower 40 is discharged to the outside through the discharge duct 30 and the discharge slit 16.

Figure 8:
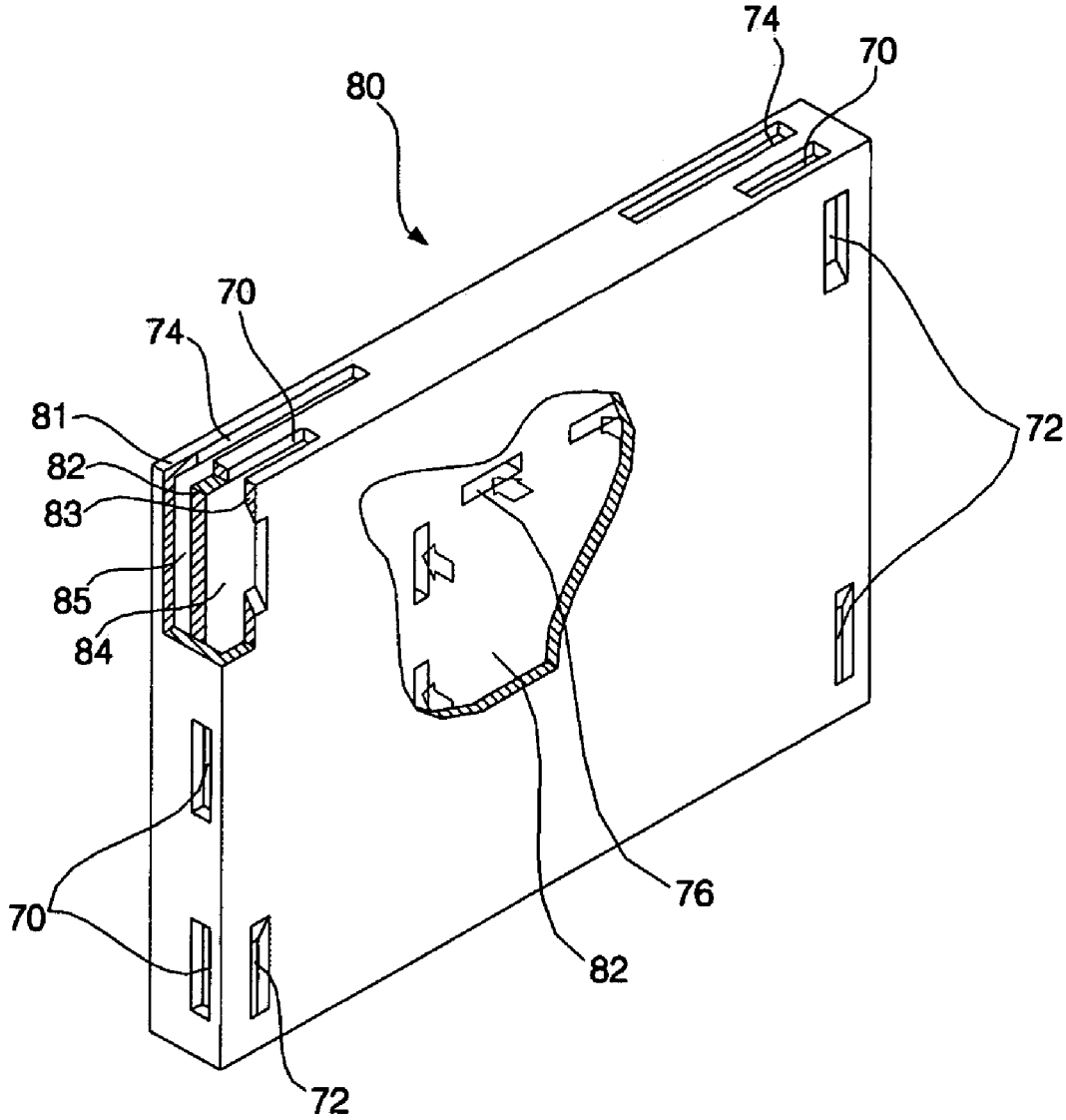
FIG. 8 is a partially exploded perspective view illustrating the structure of a door of a cooking appliance provided with a cooling apparatus in accordance with another embodiment of the present invention.

FIG. 8 is a partially exploded perspective view illustrating the structure of a door of a cooking appliance provided with a cooling apparatus in accordance with another embodiment of the present invention.

In the same manner as the above-described door 50 of the cooking appliance of the preceding embodiment, the door 80 of the cooking appliance of this embodiment forms internal and external channels 84 and 85 through first, second, and third plates 81, 82, and 83. However, the suction vents 70 communicate with the internal channel 84 of the door 80.

The air sucked through the suction vents 70 is circulated into the internal channel 84 of the door 80, such that the third plate 83 is first cooled by the air, and the air is circulated into the external channel 85 through the circulation slits 76 formed through the second plate 82. The air having passed through the external channel 85 is discharged from the door 80 through the top vents 74.

As described above, when the air is sucked into the internal channel 84 of the door 80, the external air having a low temperature first cools the third plate 83, thereby maximally preventing the thermal deformation of the door 80. The circulation slits 76 circulate the air from the internal channel 84 to the external channel 85, and generate eddy of the air in the internal channel 84, in the same manner as the preceding embodiment, during the circulation of the air. The second and third plates 82 and 83 are uniformly cooled by the eddy.

A part of the air sucked into the internal channel 84 is discharged from the door 80 through the side vents 72, and the remainder of the air flows into the external channel 85 and is discharged through the top vents 74.

As apparent from the above description, the present invention provides a cooling apparatus of a cooking appliance, which directly circulates external air toward a door and the inside of an electric component chamber, which are required to be cooled, thereby improving cooling efficiency of the door and the inside of the electric component chamber.

Particularly, the cooling apparatus of the present invention achieves a sufficient cooling structure of the door for coping with the high temperature in a cooking chamber, thereby improving reliability of the cooking appliance.

Further, the cooling apparatus of the present invention prevents electric components in the electric component chamber from being damaged by heat or being thermally deformed, thereby improving safety of products and reliability of the cooking appliance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cooling apparatus of a cooking appliance comprising:

a cabinet having a cooking chamber located therein and an electric component chamber located outside the cooking chamber;

a door installed on the cabinet for opening and closing the cooking chamber, and having at least first and second channels so as to cause external air to flow into the electric component chamber and a part of the air to flow into the electric component chamber via side surfaces of the cooking chamber; and an air blower installed in the electric component chamber for forcibly sucking the external air and discharging air having cooled the door and the electric component chamber, wherein the door includes:

at least first, second and third plates separated from each other to form the at least first and second channels, said second channel being closer to an inner surface of the door than the first channel;

suction vents connected to the first channel formed through at least one surface of side surfaces and an upper surface of the door and for sucking air into the first channel; and at least one discharge vent connected to the second channel and for discharging air within the door to at least the electronic component chamber, and wherein the second plate between the first and third plates include circulation slits such that the air sucked into the first channel flows through the circulation slits and into the second channel and then discharges through the at least one discharge vent connected to the second channel.

2. The cooling apparatus as set forth in claim 1, wherein the at least one discharge vent includes side vents for causing the air to flow into said side surfaces of the cooking chamber formed through the inner surface of the door.

3. The cooling apparatus as set forth in claim 1, wherein the at least one discharge vent includes top vents for discharging the air to the electric component chamber formed through an upper surface of the door.

4. The cooling apparatus as set forth in claim 1, further comprising:

an intake channel for sucking the air into the air blower; and a discharge channel for discharging the air from the air blower, wherein the intake channel and the discharge channel are separated from each other.

5. The cooling apparatus as set forth in claim 4, wherein the discharge channel comprises a discharge duct connected to the air blower in front of the cabinet.

6. A cooling apparatus of a cooking appliance comprising:

a cabinet having a cooking chamber located therein and an electric component chamber located outside the cooking chamber;

a door installed on the cabinet for opening and closing the cooking chamber, and having at least first and second channels so as to cause external air to flow into the electric component chamber; and an air blower installed in the electric component chamber for forcibly sucking the external air and discharging air having cooled the door and the electric component chamber, wherein the door includes:

at least first, second and third plates separated from each other to form the at least first and second channels, said second channel being closer to an inner surface of the door than the first channel;

suction vents connected to the second channel formed through at least one surface of side surfaces and an upper surface of the door and for sucking air into the second channel; and at least one discharge vent connected to the first channel and for discharging air within the door to at least the electronic component chamber, and wherein the second plate between the first and third plates includes circulation slits such that the air sucked into the second channel flows through the circulation slits and into the first channel and then discharges through the at least one discharge vent connected to the first channel.

7. The cooling apparatus as set forth in claim 6, wherein the at least one discharge vent includes side vents for causing the air to flow into both side surfaces of the cooking chamber formed through the inner surface of the door.

8. The cooling apparatus as set forth in claim 6, wherein the at least one discharge vent includes top vents for discharging the air to the electric component chamber formed through an upper surface of the door.

9. The cooling apparatus as set forth in claim 6, further comprising:

an intake channel for sucking the air into the air blower; and a discharge channel for discharging the air from the air blower, wherein the intake channel and the discharge channel are separated from each other.

10. The cooling apparatus as set forth in claim 9, wherein the discharge channel comprises a discharge duct connected to the air blower in front of the cabinet.

11. The cooling apparatus as set forth in claim 1, wherein the cooking member is spaced from the cabinet via separating members such that side channels are formed between the cabinet and cooking member, said side channels leading into the electric component chamber.

12. The cooling apparatus as set forth in claim 11, wherein the at least one discharge vent includes side vents formed through the inner surface of the door such that air discharged from the side vents enters the side channels and flows into the electric component chamber.

13. The cooling apparatus as set forth in claim 6, wherein the cooking member is spaced from the cabinet via separating members such that side channels are formed between the cabinet and cooking member, said side channels leading into the electric component chamber.

14. The cooling apparatus as set forth in claim 13, wherein the at least one discharge vent includes side vents formed through the inner surface of the door such that air discharged from the side vents enters the side channels and flows into the electric component chamber.

* * * * *